United States Patent [19]

Ornsteen

[11] 4,199,082

[45] Apr. 22, 1980

[54] HOT MELT ADHESIVE GUN

[75] Inventor: Robert L. Ornsteen, Cape Neddick, Me.

[73] Assignee: Ornsteen Chemicals, Inc., Seabrook, N.H.

[21] Appl. No.: 904,438

[22] Filed: May 9, 1978

[51] Int. Cl.[2] ..... B67D 5/62

[52] U.S. Cl. ..... 222/146 HE; 222/323; 222/380; 222/389; 221/299; 221/12

[58] Field of Search ..... 222/146 H, 146 HE, 323, 222/473, 470, 389, 380; 141/21-27; 221/289, 295, 298, 299, 12, 6

[56] References Cited

U.S. PATENT DOCUMENTS

| | | | |
|---|---|---|---|
| 2,567,960 | 9/1951 | Myers et al. | 222/146 HE |
| 2,646,199 | 7/1953 | Paulsen | 222/146 HE |
| 2,809,772 | 10/1957 | Weisz | 222/146 HE |
| 3,082,907 | 3/1963 | Patzer | 221/6 |
| 3,432,076 | 3/1969 | Arsenault | 221/295 |
| 3,773,069 | 11/1973 | Rebentisch | 222/146 HE |

*Primary Examiner*—Allen N. Knowles
*Attorney, Agent, or Firm*—Weingarten, Maxham & Schurgin

[57] ABSTRACT

A hot melt adhesive gun capable of dispensing relatively large volumes of molten adhesive and comprising a hot melt chamber and a pressurized air chamber separated by a moveable element which isolates the chambers one from the other. Molten adhesive from an associated bulk supply is fed into the hot melt chamber by means of a supply nozzle temporarily plugged into a valved inlet passage of the gun only when necessary to charge the gun with a fresh supply of molten adhesive. Upon actuation of the gun trigger, pressurized air in the air chamber, drives the moveable element forward to cause adhesive to flow out of the nozzle. Upon release of the trigger, adhesive flow from the nozzle valve is discontinued. The novel gun also includes a pressure relief valve and relief port to allow the escape of trapped gas which can build up in the melted adhesive and which exceeds a predetermined pressure level.

30 Claims, 12 Drawing Figures

HOT MELT ADHESIVE GUN

FIELD OF THE INVENTION

This invention relates to adhesive dispensing apparatus and more particularly to a hot melt adhesive gun adapted to be charged with molten adhesive from an associated bulk supply.

BACKGROUND OF THE INVENTION

Hot melt adhesive guns are known in which a cartridge of normally solid adhesive is inserted within a heated chamber of the gun, a portion of the cartridge being successively melted to provide a quantity of molten adhesive for dispensing from the gun nozzle. The rate at which a normally solid adhesive cartridge can be melted is governed by the diameter of the cartridge which confronts the heating surface in the gun chamber and by the operating temperature of the heating surface. To achieve a higher melting rate, a larger diameter cartridge can be employed for a given temperature but this would of course necessitate a gun of larger size and can result in a gun of unwieldy size to achieve certain high melting rates. The melting rate can be increased in a gun of smaller size by increasing the operating temperature, but higher temperatures can cause degradation of the adhesive composition. In addition, the higher temperature further lowers the viscosity of the molten adhesive and increases the likelihood of back flow of adhesive within the gun mechanism, with consequent contamination of the gun.

Heretofore, to satisfy the requirement for relatively large dispensing rates, typically greater than about 20 pounds of hot melt per day, bulk reservoir systems have been employed in which a heated tank containing a relatively large quantity of hot melt adhesive is coupled via a hose to a dispensing gun and molten adhesive pumped from the tank to the gun for dispensing. Such bulk systems in addition to being cumbersome are quite restrictive in use by reason of the attached bulky hoses. In addition, the hose often contains heaters to maintain the adhesive in liquid form, and flexing of the hose during use shortens the lifetime of the hose to an average of only about 4 or 5 months in typical installations. As a result, the maintenance cost of such bulk systems can be considerable. Moreover, the hose is usually plastic lined, which limits the permissable operating temperatures which can be employed without damage to the hose itself.

SUMMARY OF THE INVENTION

In brief, the present invention provides a hot melt adhesive gun capable of dispensing relatively large volumes of molten adhesive without necessity for continuous attachment to a bulk supply during use and in which the adhesive is isolated from the air supply in a closed system. The novel gun includes a hot melt chamber and a pressurized air chamber separated by a moveable element which can be a flexible diaphragm or a piston. Molten adhesive from an associated bulk supply is fed into the hot melt chamber by means of a supply nozzle which is temporarily plugged into a valved inlet passage of the gun only when necessary to charge the gun with a fresh supply of molten adhesive. The moveable element is caused to move rearwardly to accomodate a charge of adhesive, and isolates the molten glue from the pressurized air supply and prevents any possibility of contamination of the air lines by molten adhesive.

Moreover, the air supply is isolated by the moveable element from the adhesive and cannot oxidize or otherwise contaminate the adhesive.

Upon actuation of the gun trigger, the moveable element under the urging of pressurized air is driven forward to force the molten adhesive within the hot melt chamber out of the nozzle for dispensing onto a work surface. Adhesive continues to be dispensed so long as the trigger is actuated, and so long as a supply of molten adhesive remains within the gun chamber. Upon release of the trigger, adhesive flow from the nozzle is discontinued. The novel gun includes a pressure relief valve and relief port to allow the escape of trapped gas which can build up in the melted adhesive and which exceeds a predetermined level.

A bulk hot melt adhesive supply system is provided by the invention and is operative to be coupled to the adhesive gun for periodic charging of the gun as required during use. The bulk supply system includes a reservoir chamber above which is supported an adhesive cartridge which is selectively lowered as necessary to maintain an intended quantity of molten adhesive within the reservoir. A metering chamber is provided below the reservoir chamber and includes a pneumatically operative mechanism for drawing a predetermined quantity of molten adhesive into the metering chamber and propelling the metered charge of molten adhesive into the adhesive chamber of an associated gun which during charging is coupled to a supply nozzle of the bulk system. Means are provided to inhibit the supply of adhesive from the bulk system except when an adhesive gun is properly coupled to the supply nozzle.

DESCRIPTION OF THE DRAWINGS

The invention will be more fully understood in the following detailed description taken in conjunction with the accompanying drawing in which.

DETAILED DESCRIPTION OF THE INVENTION

Figure 1:
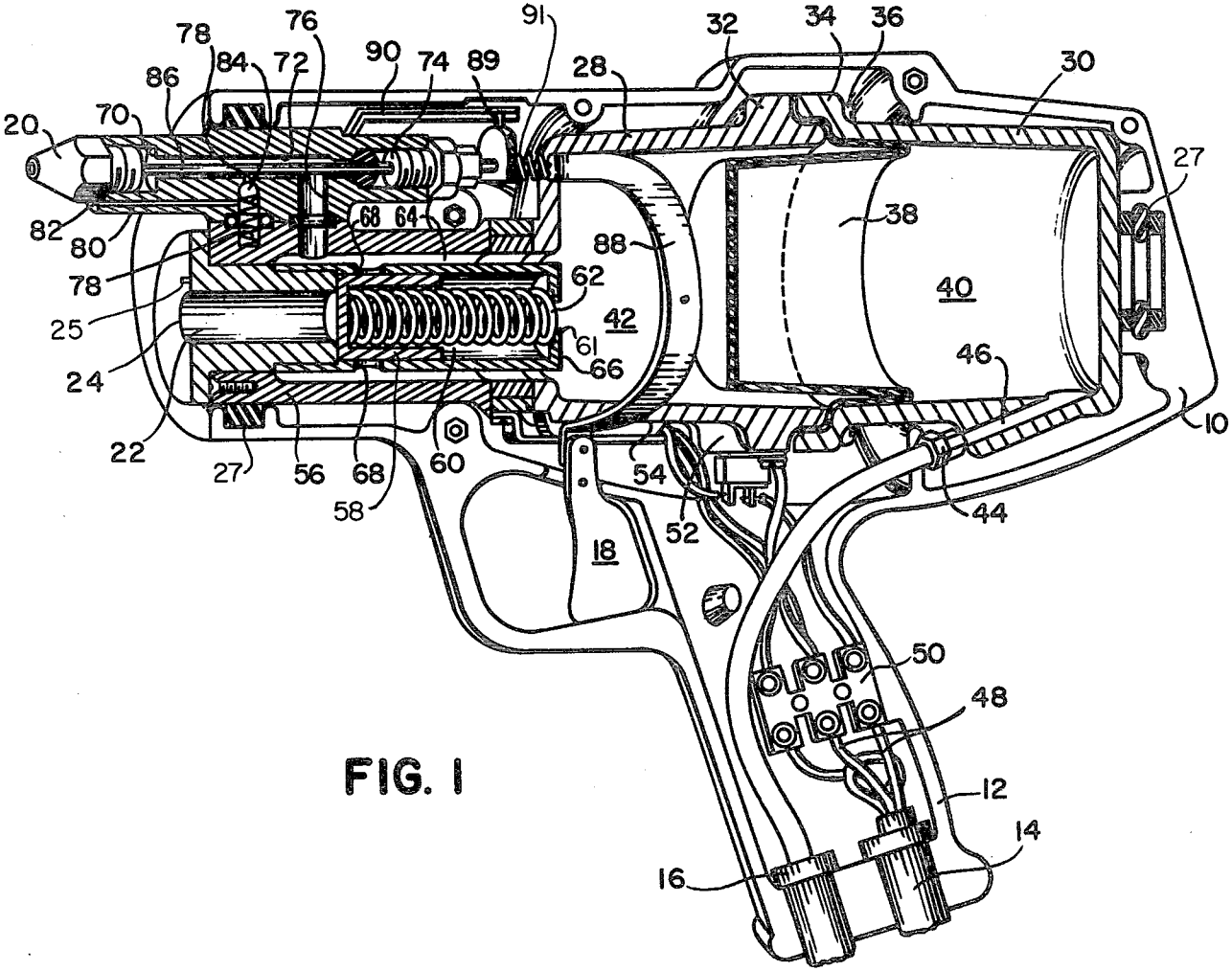
FIG. 1 is a sectional elevational view of a hot melt adhesive gun according to the invention.
Figure 2:
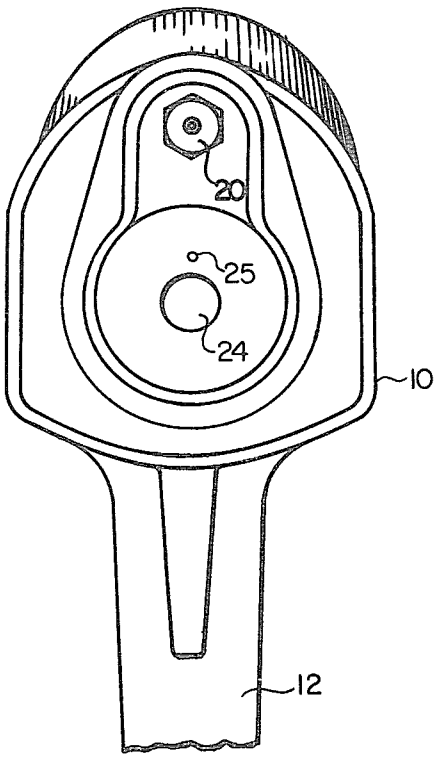
FIG. 2 is a front elevation view of the embodiment of FIG. 1.

A hot melt adhesive gun constructed and operative according to the invention is shown in FIGS. 1 and 2 and in exterior appearance includes a case 10 generally formed of a molded plastic material and having a handle 12 in which an electrical power cable 14 and an air supply 16 are disposed, and an operating trigger 18. A dispensing nozzle 20 is provided at the forward end of the gun and outwardly extending therefrom. An inlet passage 22 is provided in the forward portion of the gun terminating in an opening 24 at the front end of the gun and into which a supply nozzle from a supply source can be inserted and coupled to the gun for charging of the hot melt chamber.

A housing 28 is disposed within the outer case 10 and includes a rearward housing section 30 removably attached to housing 28 by cooperating flanges 32 and 34 and fasteners 36. A flexible generally cup-shaped diaphragm or bladder 38 is disposed within the housing and is secured at its circumferential edge between the mating flanges 32 and 34. The bladder 38 provides a substantially sealed barrier between an air chamber 40 defined by the rearward housing section 30 and the bladder, and a hot melt chamber 42 defined by the housing 28 and the bladder. The bladder 28 is flexible to move rearwardly in response to melted adhesive introduced into chamber 42, and to move forwardly in response to air pressure within chamber 40 and dispensing of adhesive from chamber 42. The case 10 is attached to housing 28 by a thermally insulative ring 29 at the forward end and by insulative ring 27 at the rearward end, such that the outer case remains relatively insulated from the heated housing.

The air supply line 16 disposed in handle 12 is coupled by a fitting 44 to an air supply passage 46 which communicates with air chamber 40. Pressurized air from a suitable source is introduced into chamber 40 to maintain this chamber under a predetermined operating pressure for dispensing of adhesive from chamber 42 upon actuation of trigger 18. The electrical cable 14 disposed in handle 12 has wires 48 connected, via a terminal strip 50 within the gun handle, to a thermostat 52 and one or more electrical heaters 54 disposed in the housing to maintain an intended operating temperature.

The inlet passage 22 is provided within a forward housing section 56 and extends inwardly into communication with a slide valve composed of a cylindrical sleeve 58 having a closed end wall and biased within cylindrical passage 60 by a spring 62. The inner end of passage 60 communicates with chamber 42 by way of a port 61 which serves to vent the slide valve. An annular passage 64 is defined by the member 66 in which passage 60 is provided, and the surrounding portion of housing section 56. The annular passage 64 communicates at its inner end with hot melt chamber 42 and includes ports 68 which provide communication between passage 64 and passage 60, with the valve sleeve 58 in its inward open position. In the position illustrated in FIG. 1, the valve sleeve 58 is in its closed forward position occluding ports 68.

The nozzle 20 is threaded or otherwise installed within an opening 70 which communicates by way of a rearwardly extending passage 72 to an opening 74. A passage 76 extends between passage 72 and annular passage 64 by which hot melt adhesive from chamber 42 can flow for dispensing from nozzle 20. A passage 78 provides communication between passage 72 and a passage 80 which terminates in a relief port 82 adjacent nozzle 20. A spring loaded ball valve 84 is normally closed and isolates passage 72 from vent passage 80. In the presence of pressure within 72 above a predetermined level, ball valve 84 opens to permit pressure relief via the passage 80 and port 82.

Figure 3:
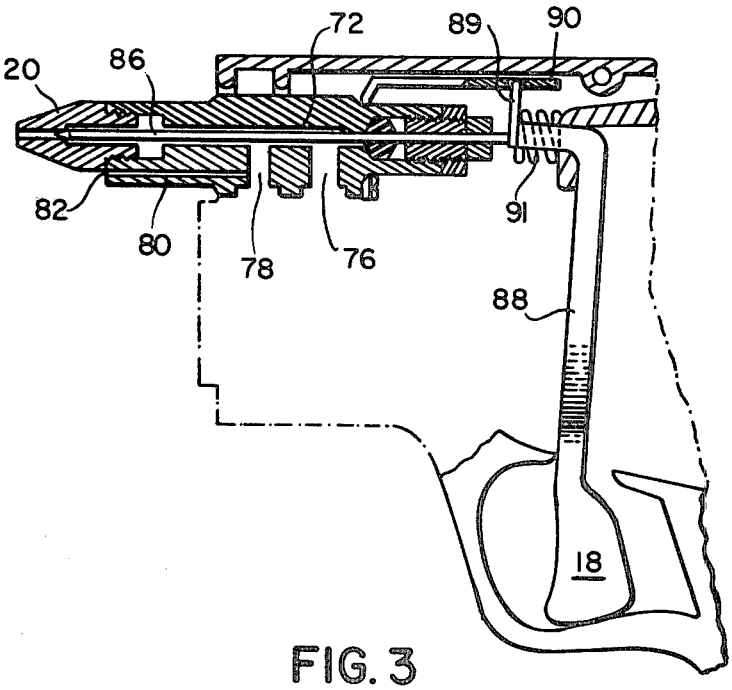
FIGS. 3 and 4 are sectional elevational views of the needle valve assembly in closed and open positions, respectively.

A needle shaft 86 is disposed within passage 72, the forward end being cooperative with nozzle 20 to provide a needle valve, and the rearward end being affixed to a yoke 88 to which trigger 18 is attached. The yoke 88 includes a pivot pin 89 which is disposed in a cooperative opening in a bracket 90. The shaft 86 is biased into a normally closed position by a spring 91 disposed rearward of yoke 88 and urging the yoke and shaft forward. The needle valve is shown in FIG. 3 in its closed position, and in FIG. 4 in its open position.

To charge the gun, the supply nozzle of an associated molten adhesive supply, such as the heated bulk tank to be described, is inserted within passage 22 and is operative to push valve sleeve 58 rearward to its open position. Hot melt adhesive from the supply tank or other source is caused to flow by pumping or by gravity feed out of the coupled supply nozzle into ports 68 and annular passage 64 and into hot melt chamber 42. The bladder 38 is caused to move rearwardly under the pressure of the supplied hot melt adhesive, the bladder in its fully rearward position being slightly smaller than the interior of housing section 30 and terminating approximately at the rear wall of chamber 40. During introduction of hot melt adhesive from the supply nozzle into chamber 42, adhesive also flows from ports 68 via passage 76 but is not dispensed from the nozzle 20, since the nozzle valve remains closed, so long as trigger 18 remains in its released position. When the hot melt chamber is filled, the supply nozzle is removed from the gun inlet passage 22, causing return of valve sleeve 58 to its closed position covering ports 68 of the inlet passage. Coupling means can be provided in association with the inlet passage 22 for actuating an external supply nozzle or securing the gun to the supply nozzle. In the gun being described, a pin 25 protrudes from the front of the gun adjacent port 24 and is cooperative in a manner to be described to enable loading of a change of molten adhesive from a bulk supply.

Figure 4:
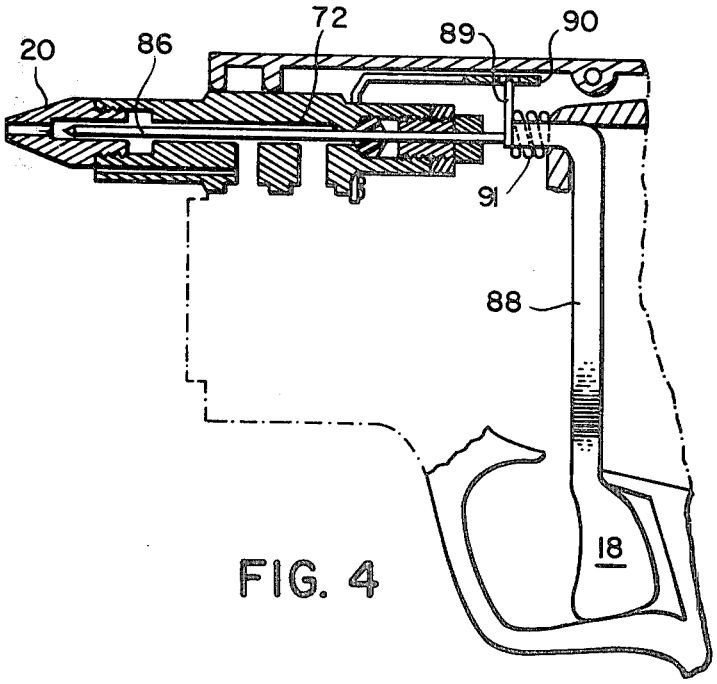

A charge of hot melt adhesive is thus loaded into chamber 42 and upon actuation of trigger 18, as shown in FIG. 4, the needle valve in nozzle 20 is opened to cause adhesive within chamber 42 to flow through passages 64, 76, and 72 out of the nozzle port. As shown in FIG. 3, upon release of trigger 18, the needle valve in nozzle 20 is closed thereby discontinuing flow of adhesive from the nozzle. As adhesive is dispensed from the gun, the supply of adhesive within chamber 42 is successively diminshed, allowing the chamber to become smaller by the inward movement of bladder 38 under the influence of applied air pressure in chamber 40. The molten adhesive is completely isolated from the air supply lines by the interposed bladder; thus, the air supply cannot be contaminated or interferred with by the melted adhesive, and the adhesive cannot be oxidized or otherwise affected by the supplied air.

In the event that pressure above a predetermined level occurs in passage 72, such as from pressure build-up of occluded gas within the hot melt adhesive, ball valve 84 opens to allow pressure relief by escape of gas and adhesive out of the relief port 82.

Figure 5:
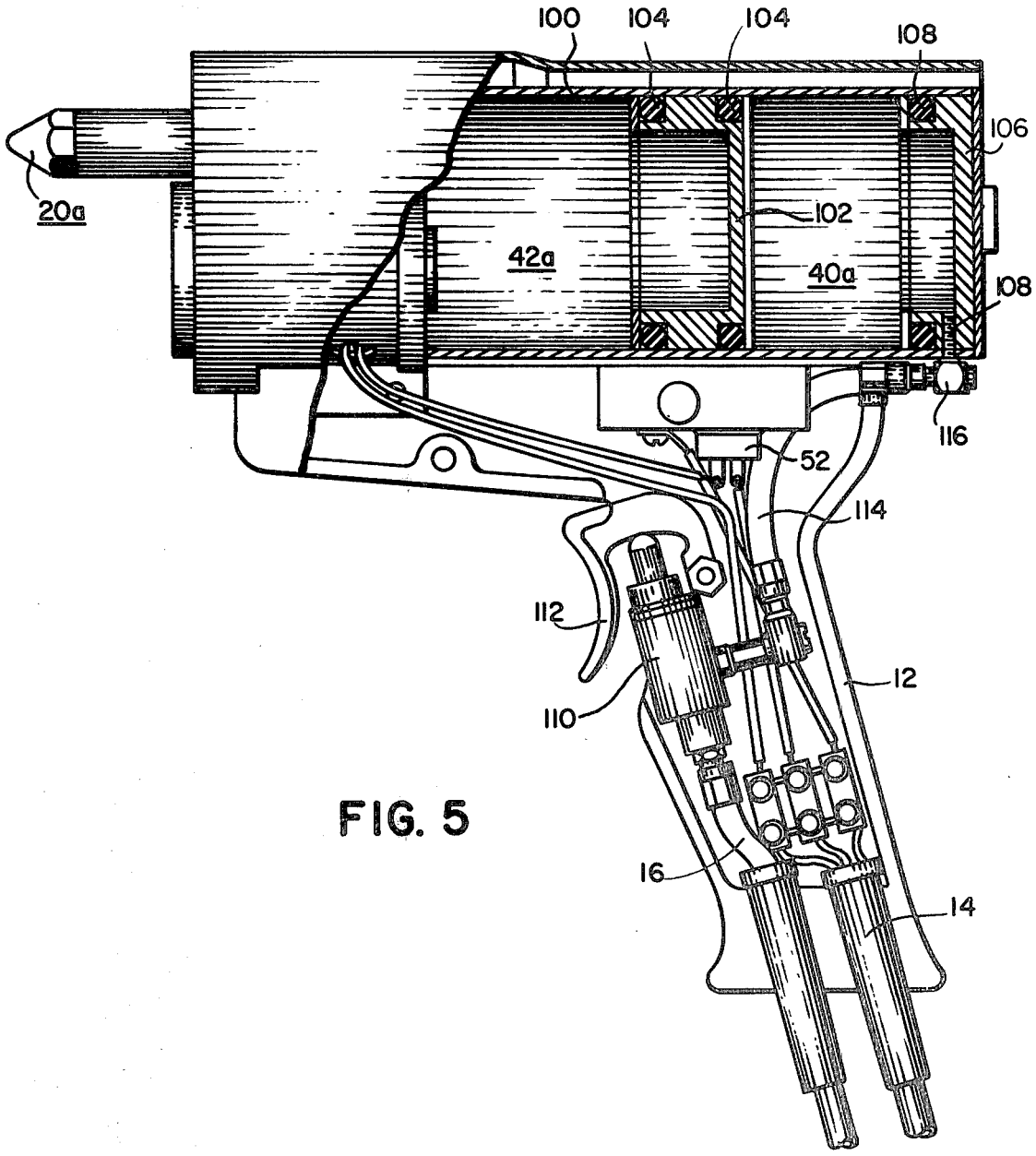
FIG. 5 is a partly sectional elevation view of an alternative adhesive gun embodiment according to the invention.
Figure 6:
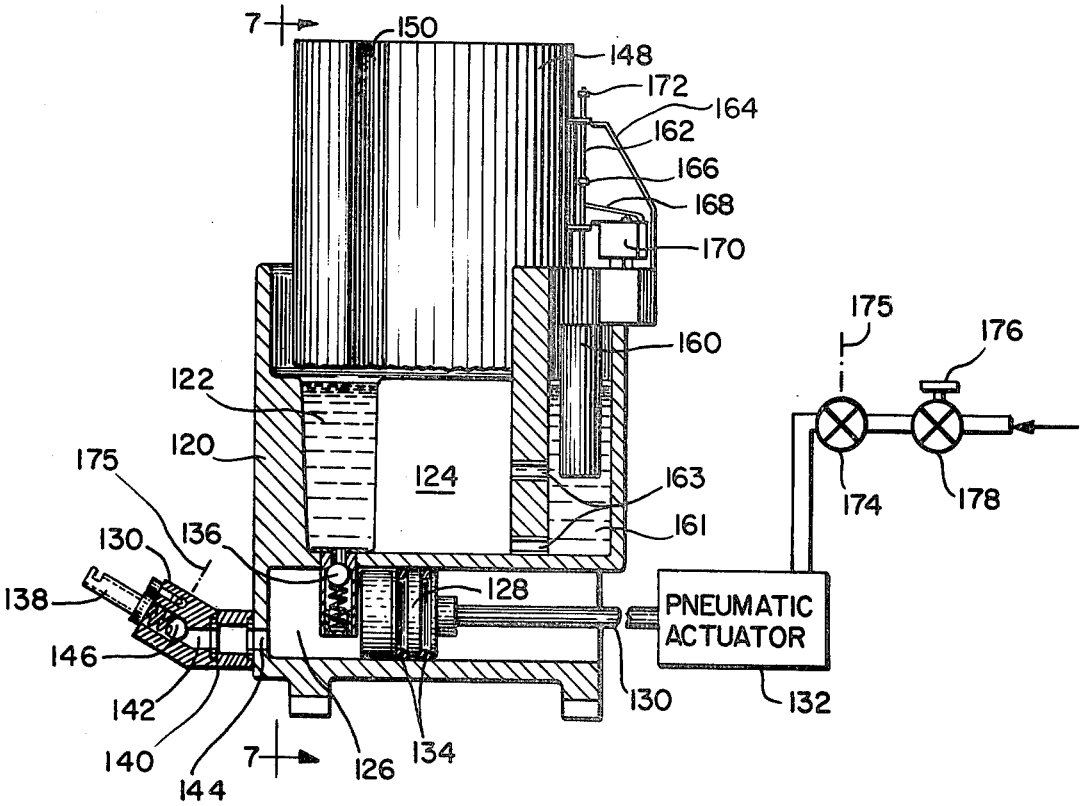
FIG. 6 is a sectional side elevation view of a bulk supply system according to the invention.
Figure 7:
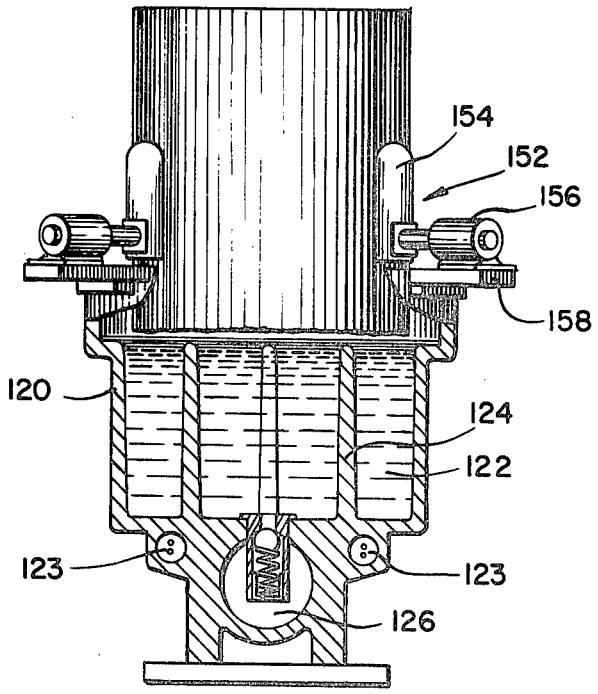
FIG. 7 is a sectional front elevation view of the system of FIG. 6.

An alternative embodiment of the hot melt adhesive gun is shown in FIG. 5 in which the diaphragm or bladder of the above-described embodiment is replaced with a piston movable within the housing and separating the hot melt chamber from the air chamber. Referring to FIG. 5 it is seen that the gun includes a cylindrical housing 100 having a piston 102 slidably disposed therein and separating air chamber 40*a* from hot melt chamber 42*a*. The piston 102 includes O-rings 104 for sealing engagement with the confronting surface of housing 100. In the illustration embodiment the piston 102 is of cup-shaped configuration to provide greater capacity to the hot melt chamber while also providing proper sealed engagement between the hot melt chamber and the air chamber. An end plate 106 is secured to the rear housing 100 and is in sealed engagement such as by an O-ring 108 to provide a sealed air chamber 40*a*. The removable end plate 106 facilitates assembly and repair of the gun since the piston 102 is readily accessible after removal of the end plate. A valve 110 operated by trigger 112 couples air supply line 16 to chamber 40*a* by means of air line 114 and fitting 116 which communicates with air supply passage 118 in end plate 106. The valve 110 can be a flow control valve to provide a variable flow of adhesive from the gun nozzle depending upon the degree of movement of the trigger. As in the earlier described embodiment, an electrical power cable 14 has wires connected via a terminal strip to a thermostat 52 and one or more electrical heaters disposed in the forward section of the housing to maintain an intended operating temperature.

Upon actuation of trigger 112, valve 110 is opened to allow the supply of pressurized air into chamber 40*a* to cause forward urging of piston 102 against the molten adhesive within chamber 42 to propel molten adhesive through the adhesive supply passages as described above into nozzle 20*a*. In this embodiment, the nozzle 20*a* includes a spring loaded ball check valve of any well-known construction which is opened in response to the pressure of molten adhesive to permit dispensing of adhesive from the nozzle orifice. Adhesive continues to be dispensed for so long as trigger 112 is depressed and provided that the molten adhesive supply within chamber 42*a* is not exhausted. Upon release of trigger 112, valve 110 is closed to discontinue the supply of pressurized air to chamber 40*a*. In the absence of the pressure of molten adhesive, the nozzle check valve closes, discontinuing adhesive flow from the nozzle. The air supply is segretated from the adhesive supply by the piston so that the gun can be operated in any position without danger of contamination of the air supply lines by adhesive.

The chamber 42*a* is charged in the manner described above to provide a supply of adhesive to the gun. During introduction of a charge of molten adhesive into chamber 42*a*, piston 102 is propelled rearward into contact with the inner surface of endplate 106 to provide the greatest volume for a full charge of adhesive.

The embodiment of FIG. 5 is charged in similar manner to the embodiment described above. The supply nozzle of a molten adhesive supply such as a heated bulk tank is inserted within the supply passage at the forward end of the gun housing and is operative to push the valve sleeve rearward to its open position to permit hot melt adhesive from the supply tank to flow from the supply nozzle into hot melt chamber 42*a*. Piston 102 is caused to move rearwardly under the pressure of the supplied hot melt adhesive. In its rearmost position the piston 102 engages the innermost surface of endplate 106. The check valve in nozzle 20*a* can be of any well known form. The spring of the nozzle check valve has sufficient force to maintain the nozzle valve closed in the presence of residual pressure of molten adhesive present during charging of the gun.

Referring to FIGS. 6–9, there is shown a tank housing 120 defining a reservoir chamber 122 and in the bottom portion of which is disposed a plurality of upstanding plates 124 which extend partially across the reservoir and have upper edges at approximately the maximum level of molten adhesive in chamber 122. The housing 120 is typically cast as a single unit from a suitable metal such as aluminum and in the illustrated embodiment has a cylindrical chamber 122. A horizontally extending chamber 126 is disposed below chamber 122 and has associated with a cylindrical portion thereof a piston 128 coupled to a shaft 130 which is also coupled to a pneumatic actuator 132 operative to drive piston 128 inward and outward within cylinder 126. The piston is in sealed sliding engagement with the confronting walls of cylinder 126 by O-rings 134. A ball check valve 136 provides selective liquid communication between chamber 122 and cylinder 126 and which is normally closed to isolate chamber 122 from cylinder 126.

An outlet nozzle 138 is provided in a body 140 attached to the lower portion of housing 120, and having a passage 142 coupling an oulet port 144 of cylinder 126 to the nozzle 138 by means of a normally closed ball check valve 146. A passage 139 is provided in body 140 adjacent to nozzle 138 and has a port vented to the atmosphere. This passage is coupled by a suitable air line to a bleed valve 174, the coupling being depicted schematically in FIG. 6 by dotted line 175. When an adhesive gun is coupled to nozzle 138, the passage 139 is sealed by pin 25 (FIG. 1) on the gun, or by any other appropriate means for occluding the vent port. One or more electrical heaters 123 are provided in housing 120 for maintaining an operating temperature to retain the adhesive in the reservoir in a molten condition. Appropriate thermostatic control of the heaters is usually provided.

The hot melt adhesive cartridge 148 includes three grooves 150 equally spaced around the perimeter of the cartridge and extending the full length thereof. The grooves are cooperative with respective holding clamp assemblies 152 which each include a clamping block 154 coupled to a solenoid actuator 156 supported by a thermally insulative mounting plate 158, which, in turn, is supported on housing 120. The solenoid actuators 156 in their normal or rest position urge blocks 154 into clamped engagement with the cooperative grooves 150 of cartridge 148 in order to retain the cartridge at a given vertical position within the tank. Upon actuation of the solenoids, the clamping blocks 154 are retracted by a sufficient amount to permit cartridge 148 to drop to a lower position in engagement with the upper surfaces of plates 124 for melting of the lower portion of the cartridge.

The solenoid actuators are energized automatically by a float assembly which includes a float 160 disposed in a chamber 161 which communicates with chamber 122 by way of passage 163. The float is guided for floating vertical movement by a rod 162 and cooperative bracket 164 which is attached to housing 120. A stop collar 166 is affixed at a predetermined position along the length of rod 162 and is operative to actuate the arm 168 of a switch 170 when float 150 reaches a predetermined lower limit level. A stop collar 172 is provided at the upper end of rod 162 and is engageable with the upper portion of bracket 164 to limit the downward movement of float 160. The float 160 follows the level of molten adhesive within chamber 122 and at a predetermined lower level, causes actuation of switch 170 to cause closure of a circuit for energizing solenoids 156.

Upon actuation of the solenoids, the clamp blocks 154 are caused to retract to permit downward movement of the adhesive cartridge 148 against the plates 124 to heat and melt a quantity of adhesive for replenishment of the adhesive supply in chamber 122. The cartridge 148 is melted until the level of the adhesive supply reaches an upper level sufficient to open switch 170, thereby deenergizing the solenoids and causing reclamping of the cartridge by the clamping blocks.

To provide a charge of molten adhesive to a hot melt gun such as that above described, the gun is inserted into nozzle 138 and the bleed passage 139 is sealed by insertion of a pin associated with the hot melt gun to enable bleed valve 174. An actuation button 176 is pushed by an operator, causing closure of the start valve 178 to couple pressurized air from a suitable supply source to pneumatic actuator 132 to cause forward propulsion of piston 128, closure of check valve 136 and opening of check valve 146 for dispensing of a quantity of adhesive from cylinder 126 into the hot melt chamber of the gun. The start valve 178 preferably includes or is associated with a delay valve or other timing mechanism such that upon a single actuation by the operator, air is supplied for a predetermined interval sufficient to dispense an intended quantity of molten adhesive into the hot melt gun. (Typically, a five second pulse of air at 90 psi is employed.) Upon detachment of the gun from the nozzle 138 the bleed valve 174 is vented via passage 139 and thereby disabled to prevent inadvertent actuation of the system, since such actuation will not couple the air supply to the pneumatic actuator 132 unless the bleed valve is closed by insertion of the gun onto nozzle 138.

Figure 10:
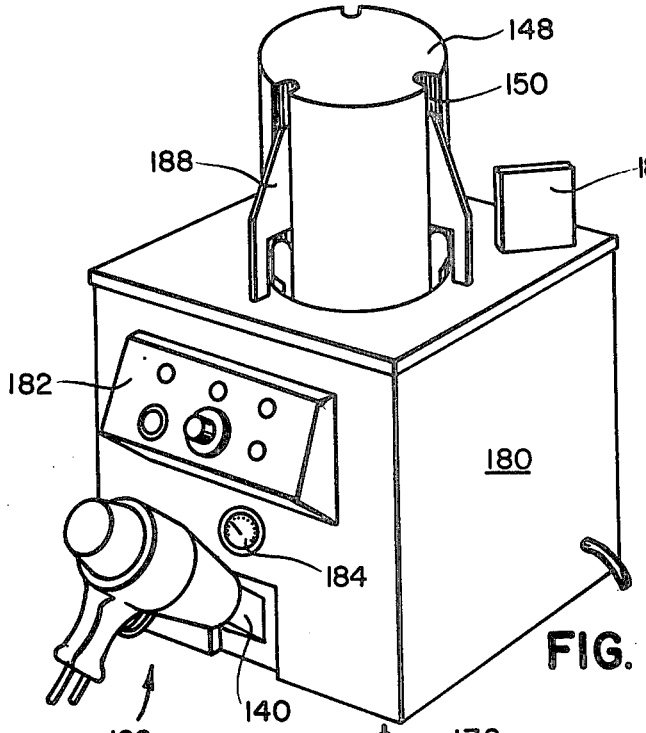
FIG. 10 is a pictorial view of the bulk supply system with an adhesive gun coupled thereto for charging.
Figure 8:
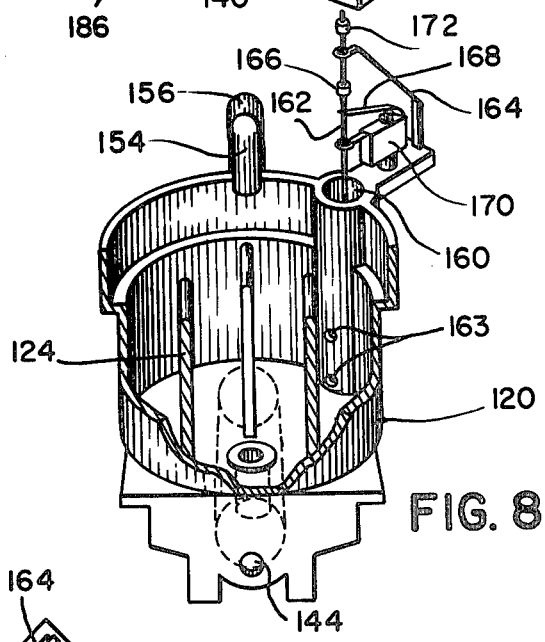
FIG. 8 is a partly cutaway pictorial view of the system of FIG. 6.
Figure 9:
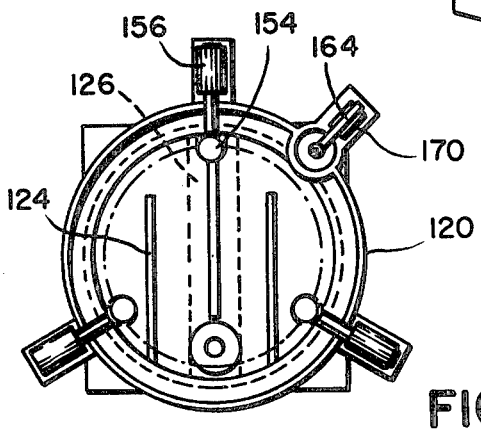
FIG. 9 is a top view of the system of FIG. 6.

The bulk supply system is contained within a housing 180, as shown in FIG. 10, which also contains a control panel 182 having operating controls and indicators. The housing also includes a cover 181 over the float assembly. A thermostat 184 is also provided for indicating the operating temperature of the reservoir. An adhesive gun 186, such as that described above, is shown coupled to the supply nozzle which outwardly extends from body 140. The alignment of adhesive cartridge 148 is maintained by means of brackets 188 attached to the top of housing 180 and adapted to fit within the respective grooves 150 of the cartridge. When the cartridge is fed downwardly upon release of the clamping assemblies, the brackets 188 retain the cartridge in a generally vertical orientation to prevent tilting or binding of the cartridge during its downward travel.

Alternatively, the bulk supply system can be employed with adhesive pellets rather than the single cartridge described above. In this alternative embodiment, the tank is filled with adhesive pellets and a quantity of these pellets are melted to provide a molten adhesive supply within the reservoir. No clamping assemblies are required in this alternative version as there is no cartridge to be supported.

Figure 11:
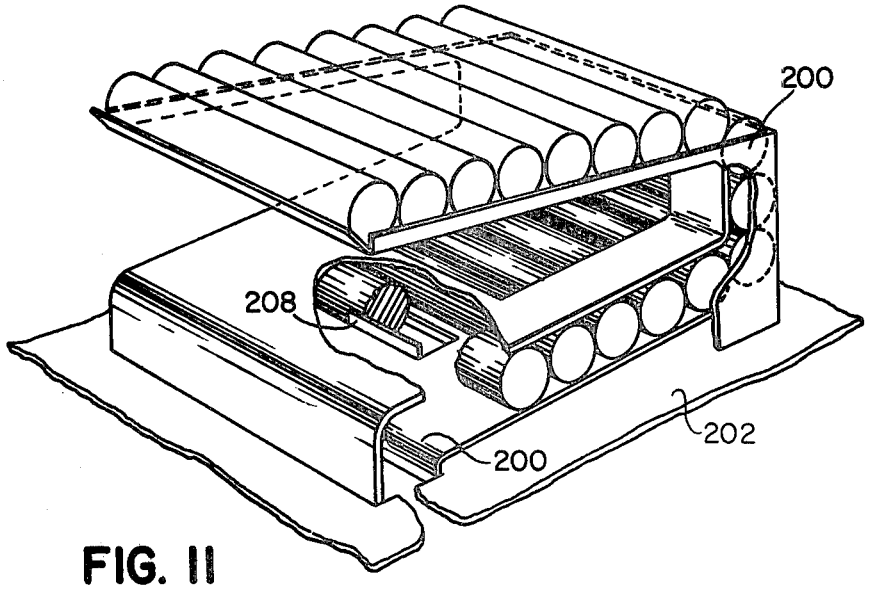
FIG. 11 is a cutaway pictorial view of glue slug supply apparatus of an alternative embodiment.

An embodiment of the bulk supply system is shown in FIG. 11 for use with glue slugs rather than the single large adhesive cartridge as in the above embodiment. A feed ramp 200 is disposed on the top of the housing 202 above the supply reservoir and is adapted to contain a plurality of cylindrical glue slugs 203 which are fed by gravity downward along the ramp for selective dispensing on demand into the adhesive chamber. A feed plate 206 having a forward upstanding lip 208 and a rearward upstanding lip 210 is pivotally mounted at the lower end of ramp 200 in a position to dispense glue slugs into the adhesive chamber. The feed plate 206 is pivoted such as by outwardly extending pivot pins 212 on each side of the feed plate and rotatably supported within corresponding journals 214 attached to the mounting plate 116. A bracket 218 is provided on the bottom of feed plate 206 and to which is pivotally attached a piston rod 220 of a normally extended air cylinder 222.

The cylinder 222 is attached to mounting plate 216 such as by bracket 224. The cylinder 222 is coupled by an air line 226 to a normally closed solenoid driven valve 228 which is coupled via a manually operable valve 230 to a pressurized air source. A normally open switch 232 electrically couples an electrical energy source to the solenoid valve 228, the switch 232 being closed by engagement of switch arm 234 by the bracket 236 of float 238.

Figure 12:
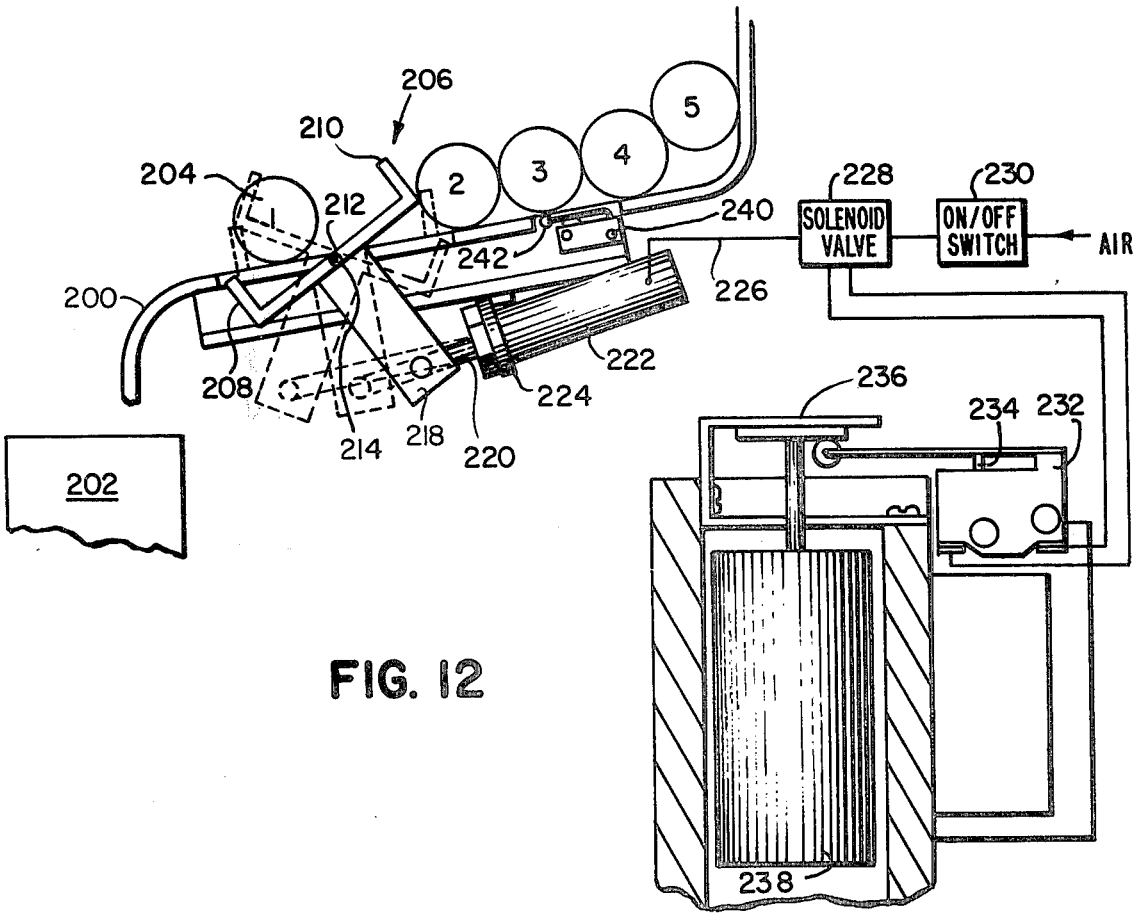
FIG. 12 is a partly sectional elevation view of the alternative embodiment using glue slugs.

When the level of molten adhesive in the adhesive chamber is above a predetermined level, the switch 232 remains in its normally open state and thus valve 228 remains closed and piston 220 remains in its extended position, as illustrated in FIG. 12 to orient the feed plate 206 in its upper position wherein the lowermost glue slug 204 is retained by the forward lip 208 of the feed plate. Upon actuation of the cylinder 222, piston 220 is caused to retract the pivot feed plate 206 as shown in FIG. 12 to allow the lower most glue slug to roll off of the feed ramp 200 into the adhesive chamber for melting and to thereby replenish the supply of molten adhesive.

In its downwardly pivoted position, the rearward lip 210 of the feed plate 206 is elevated into the path of the other glue slugs on the feed ramp to block their downward movement. Thus, a single glue slug is dispensed upon each actuation of cylinder 222. Typically, the glue slugs are $1\frac{3}{4}$ inches in diameter by 4 inches in length, weight $\frac{3}{4}$ of a pound; thus, $\frac{3}{4}$ of a pound of adhesive is added to the reservoir each time the reservoir level drops sufficiently to provide automatic dispensing of a new slug. Maintainance of a substantially constant molten adhesive level in the reservoir prevents carbonization of the glue and insures a consistent temperature gradient which contributes to a steady melting rate sufficient to feed one or more associated guns.

When the adhesive level in the reservoir falls below a predetermined level, the float 238 and its associated bracket 236 causes actuation of switch arm 234 to provide an electrical signal to valve 228 for opening of the valve. Preferably the valve permits operation of cylinder 222 for a predetermined interval of time, typically 5 seconds, after which the air supply is shut off to cause deactuation of cylinder 222 and return of piston 220 to its extended normal position. Such an operating interval can be provided by a valve 228 which includes or which is associated with a timing mechanism. Use can be made of a pulsed air source such as described above to provide a loading cycle to charge an associated gun with a supply of adhesive. Upon manual actuation of valve 230 a pulse of air of intended duration, typically five seconds, is provided to cylinder 222 to provide a period of cylinder actuation for dispensing of a single glue slug into the reservoir, after which the cylinder 222 is deenergized to return feed plate 206 to its normal upward position for receipt of the next glue slug to be dispensed on the next command.

The same air pulses as used to charge a gun coupled to the bulk supply can be conveniently used to dispense a glue slug when required by the level of the adhesive reservoir falling below the limit. Thus, the feed system is enabled by closure of switch 232 whenever the molten adhesive supply falls below a predetermined lower limit; however, a new glue slug is not fed into the reservoir until the actuator button is depressed for charging of the gun coupled to the bulk supply tank.

A microswitch 240 and associated switch arm 242 are provided at the lower portion of the feed ramp 200 to sense when only a predetermined number of slugs remain on the ramp. In the illustrated embodiment, the presence of only two glue slugs causes switch arm 242 to rise and actuate switch 240 to provide a warning indication, such as by a warning light on the front panel, that the feed ramp should be resupplied with glue slugs.

Although the adhesive gun and bulk supply described above are especially suited to use with each other, it will be appreciated that the gun and bulk supply need not necessarily be used together. The novel gun can be supplied with a charge of molten adhesive from other bulk supply sources which have a supply fitting compatible with the corresponding gun mechanism. The bulk supply system can also be employed with other types of adhesive guns adapted to receive a charge of molten adhesive for subsequent dispensing from the gun. The details of implementation of a hot melt adhesive gun and bulk supply constructed in accordance with the invention can vary to suit particular performance requirements. Accordingly, the invention is not to be limited by what has been particularly shown and described except as indicated in the appended claims.

What is claimed is:

1. A hot melt adhesive gun comprising:

a housing having a hot melt chamber for containing a charge of molten hot melt adhesive, and an air chamber adapted to contain a supply of pressurized air;

a moveable element disposed within said housing and providing a moveable barrier isolating said hot melt chamber from said air chamber;

means for heating said hot melt chamber to a predetermined temperature to maintain said adhesive in a molten condition;

nozzle means coupled to the forward end of said hot melt chamber and including a normally closed nozzle valve;

trigger means operative upon manual actuation to cause opening of said nozzle valve to permit the flow of adhesive from said nozzle means;

hot melt supply means including an inlet passage selectively communicating with said hot melt chamber by means of a normally closed supply valve, said inlet passage being adapted to receive a hot melt supply nozzle therein and said supply valve being opened by said supply nozzle to introduce a charge of molten hot melt adhesive into said hot melt chamber; and means coupling said air chamber to a supply of pressurized air.

2. The hot melt adhesive gun of claim 1 further including:

a relief port;

a relief valve coupling said relief port to said nozzle means, said relief valve being operative in response to pressure of the adhesive within the gun above a predetermined pressure level to open for relief of such pressure.

3. The hot melt adhesive gun of claim 1 wherein said nozzle valve includes:

a nozzle valve having a needle shaft cooperative with a nozzle and retractable upon actuation of said trigger means to open said nozzle valve.

4. The hot melt adhesive gun of claim 1 wherein said supply valve includes:

a normally closed slide valve coupling said inlet passage to said hot melt chamber.

5. The hot melt adhesive gun of claim 1 wherein said moveable element is a flexible diaphragm.

6. The hot melt adhesive gun of claim 1 wherein said moveable element is a piston slidably disposed within said housing.

7. The hot melt adhesive gun of claim 1 wherein said trigger means is mechanically linked to said nozzle valve which includes a needle valve actuated by said trigger.

8. The hot melt adhesive gun of claim 1 wherein said trigger means includes a trigger valve for selectively coupling pressurized air to said air chamber.

9. The hot melt adhesive gun of claim 1 wherein said hot melt supply means includes a normally closed slide valve coupling said passage to said hot melt chamber; and an element associated with said inlet passage and cooperative with an element associated with said hot melt supply nozzle to enable charging of said hot melt chamber.

10. A hot melt adhesive supply system comprising:

a housing having a heated reservoir chamber for containing a predetermined quantity of molten hot melt adhesive;

means for retaining one or more solid hot melt adhesive cartridges above said reservoir chamber and for permitting selected downward movement thereof into said reservoir chamber;

a metering chamber disposed below the reservoir chamber and including first valve means selectively coupling said reservoir chamber to said metering chamber, and second valve means selectively coupling said metering chamber to a supply nozzle;

means associated with said metering chamber for drawing a predetermined quantity of molten adhesive into the metering chamber from the reservoir chamber and for propelling the metered quantity of molten adhesive from the metering chamber through said nozzle to an adhesive gun coupled to said nozzle; and a plurality of spaced plates within the reservoir chamber upwardly extending to a height approximately equal to the maximum level of the supply of molten adhesive therein.

11. The hot melt adhesive supply system of claim 10 wherein said last means includes:

a piston slidably disposed in said metering chamber; and pneumatic means for moving said piston to draw a predetermined quantity of molten adhesive into the metering chamber and to propel the metered quantity of molten adhesive from the metering chamber.

12. The hot melt adhesive supply system of claim 11 wherein said pneumatic means includes a pulsed air source providing pressurized air for a predetermined time interval for operation of said piston.

13. The hot melt adhesive supply system of claim 10 wherein said first valve means is opened when drawing adhesive into the metering chamber from the reservoir chamber, and said second valve means is opened when propelling a metered quantity of molten adhesive through said nozzle.

14. The hot melt adhesive supply system of claim 13 wherein said retaining means includes a plurality of clamp assemblies disposed on said housing above said reservoir chamber and operative to selectively retain an adhesive cartridge.

15. The hot melt adhesive supply system of claim 14 further including a float assembly operative in response to a predetermined molten adhesive level in said reservoir chamber to cause release of said clamp assemblies to permit downward movement of said adhesive cartridge for melting of a predetermined quantity of adhesive to maintain a predetermined quantity of molten adhesive in said reservoir chamber.

16. The hot melt adhesive supply system of claim 10 wherein said supply nozzle is adapted for coupling to an inlet passage of an adhesive gun and including means to enable charging of said gun from said metering chamber only when said supply nozzle is coupled to said gun.

17. The hot melt adhesive supply system of claim 10 wherein said retaining means includes:

a ramp for containing a plurality of solid hot melt adhesive slugs and having an end in communication with said reservoir chamber, said ramp being inclined downwardly toward said end;

means pivotally disposed on said ramp adjacent said ramp end and adapted for dispensing one of said slugs into said reservoir chamber when the supply of melted adhesive therein falls below a predetermined level, said pivotally disposed means including a first upwardly extending lip adjacent said ramp end and a second upwardly extending lip spaced from said first lip in a direction away from said ramp end; and means adapted for pivoting said pivotally disposed means in a first direction to permit one of said slugs to roll over said second end and onto said pivotally disposed means, and for pivoting said pivotally disposed means in a second direction to lower said first lip to permit a slug contained on said pivotally disposed means to pass over said ramp end and into said reservoir chamber and to raise said second lip to prevent movement of others of said slugs remaining on said ramp.

18. The hot melt adhesive supply system of claim 17 further including means for detecting when only a predetermined number of adhesive slugs remain on said ramp and providing an indication that the slug supply should be replenished.

19. The hot melt adhesive supply system of claim 17 or 18 further including a float assembly operative in response to a predetermined molten adhesive level in said reservoir chamber to cause actuation of said pivoting means to permit one of said solid hot melt adhesive slugs to be deposited in said reservoir chamber for melting thereof to maintain a predetermined quantity of molten adhesive in said reservoir chamber.

20. Adhesive dispensing apparatus comprising:

an adhesive supply tank including a housing having a heated reservoir chamber for containing a predetermined quantity of molten hot melt adhesive;

means for retaining one or more solid hot melt adhesive cartridges above said reservoir chamber and for permitting selected downward movement thereof into said reservoir chamber;

a metering chamber disposed below said reservoir chamber and including valve means selectively coupling said reservoir chamber to said metering chamber;

a supply nozzle selectively coupled to said metering chamber by second valve means and adapted for coupling to a hot melt adhesive gun;

means associated with said metering chamber for drawing a predetermined quantity of molten adhesive into said metering chamber from said reservoir chamber and for propelling the metered quantity of molten adhesive from said metering chamber through said supply nozzle; and a hot melt adhesive gun adapted to be coupled to said supply nozzle and to receive a metered quantity of molten adhesive therefrom, said hot melt adhesive gun including:

a housing having a hot melt chamber for containing a charge of molten adhesive;

nozzle means adapted for coupling to said supply nozzle of said tank;

an inlet passage selectively communicating with said hot melt chamber by means of a normally closed supply valve, said inlet passage being adapted to receive said metered quantity of molten adhesive from said nozzle means and to conduct said metered quantity of molten adhesive to said hot melt chamber;

an air chamber adapted to contain a supply of pressurized air;

a movable element disposed within said housing and providing a movable barrier isolating said hot melt chamber from said air chamber;

means for heating said hot melt chamber to a predetermined temperature to maintain said adhesive in a molten condition;

an exit nozzle coupled to the forward end of said hot melt chamber and including a normally closed nozzle valve;

trigger means operative upon manual actuation to cause opening of said exit nozzle to permit the flow of adhesive from said exit nozzle; and means coupling said air chamber to a supply of pressurized air.

21. A hot melt adhesive supply system comprising:

a housing having a heated reservoir chamber for containing a predetermined quantity of molten hot melt adhesive;

a plurality of clamp assemblies disposed on said housing above said reservoir chamber and operative to retain an adhesive cartridge in a desired position and to selectively permit downward movement thereof into said reservoir chamber for melting selected portions thereof;

a metering chamber disposed below said reservoir chamber and including a first valve means selectively coupling said reservoir chamber to said metering chamber, and second valve means selectively coupling said metering chamber to a supply nozzle; and means associated with said metering chamber for drawing a predetermined quantity of molten adhesive into said metering chamber from said reservoir chamber and for propelling the metered quantity of molten adhesive from said metering chamber through said nozzle to an adhesive gun coupled to said nozzle.

22. A hot melt adhesive supply system comprising:

a housing having a heated reservoir chamber for containing a predetermined quantity of molten hot melt adhesive;

a plurality of clamp assemblies disposed on said housing above said reservoir chamber and operative to retain an adhesive cartridge in a desired position and to selectively permit downward movement thereof into said reservoir chamber for melting selected portions thereof;

a metering chamber disposed below said reservoir chamber and including a first valve means selectively coupling said reservoir chamber to said metering chamber, and second valve means selectively coupling said metering chamber to a supply nozzle;

means associated with said metering chamber for drawing a predetermined quantity of molten adhesive into said metering chamber from said reservoir chamber and for propelling the metered quantity of molten adhesive from said metering chamber through said nozzle to an adhesive gun coupled to said nozzle; and a float assembly operative in response to a predetermined molten adhesive level in said reservoir chamber to cause release of said clamp assemblies to permit downward movement of said adhesive cartridge for melting of a predetermined quantity of adhesive to maintain a predetermined quantity of molten adhesive in said reservoir chamber.

23. A hot melt adhesive gun comprising:

a housing having a hot melt chamber for containing a charge of molten hot melt adhesive, and an air chamber adapted to contain a supply of pressurized air;

a flexible diaphragm disposed within said housing between said hot melt chamber and said air chamber; said diaphragm isolating said hot melt chamber from said air chamber;

means for heating said hot melt chamber to a predetermined temperature to maintain said adhesive in a molten condition;

a nozzle in fluid communication with said hot melt chamber;

a normally closed needle valve within said nozzle;

trigger means operative upon manual actuation to open said needle valve to permit the flow of adhesive from said nozzle;

an inlet port mounted on the forward end of said hot melt chamber;

a passageway coupling said hot melt chamber with said inlet port and said nozzle with said hot melt chamber;

a normally closed slide valve disposed in said inlet port and adapted to be opened by the application of pressure applied by hot melt adhesive from a bulk supply means to permit passage of a quantity of melted adhesive through said annular passageway and into said hot melt chamber; and means for introducing a supply of pressurized air into said air chamber to cause said diaphragm to deform towards said nozzle to cause expulsion of melted adhesive from said hot melt chamber and said nozzle when said needle valve is in an open position.

24. A hot melt adhesive gun comprising:

a housing having a hot melt chamber for containing a charge of molten hot melt adhesive, and an air chamber adapted to contain a supply of pressurized air;

a piston slidably disposed within said housing and providing a movable barrier between said hot melt chamber and said air chamber, said piston isolating said hot melt chamber from said air chamber;

means for heating said hot melt chamber to a predetermined temperature to maintain said adhesive in a molten condition;

a nozzle in fluid communication with said hot melt chamber;

a normally closed spring-loaded ball check valve within said nozzle which is adapted to open when the pressure in said hot melt chamber exceeds a predetermined level;

an inlet port mounted on the forward end of said hot melt chamber;

a passageway coupling said hot melt chamber with said inlet port and coupling said nozzle with said hot melt chamber;

a normally closed slide valve disposed in said inlet port and adapted to be opened by the application of pressure applied by hot melt adhesive from a bulk supply means to permit passage of a quantity of melted adhesive through said passageway and into said hot melt chamber;

means adapted for supplying air to said air chamber to drive said piston towards said hot melt chamber for providing sufficient adhesive pressure in said hot melt chamber to urge open said ball check valve to permit a flow of molten adhesive from said nozzle; and trigger means operative upon manual actuation to couple said air supplying means to said air chamber.

25. A hot melt adhesive supply system comprising:

a housing having a heated reservoir chamber for containing a predetermined quantity of molten hot melt adhesive;

a plurality of clamp assemblies disposed on said housing above said reservoir chamber and operative to retain an adhesive cartridge in a desired position and to selectively permit downward movement thereof into said reservoir chamber for melting selected portions thereof;

a plurality of spaced plates disposed within said reservoir chamber and extending upwardly to a height approximately equal to the maximum level of the supply of molten adhesive therein, said plates having upper edges against which a lower end of said adhesive cartridge is permitted to rest during melting thereof;

a metering chamber disposed below said reservoir chamber and having a first valve means selectively coupling said reservoir chamber to said metering chamber and a second valve means selectively coupling said metering chamber to a supply nozzle;

a piston associated with said metering chamber for drawing a predetermined quantity of molten adhesive into said metering chamber from said reservoir chamber through said first valve means and for propelling the metered quantity of molten adhesive from said metering chamber through said nozzle to an adhesive gun coupled to said nozzle;

pneumatic means for actuating said piston for a predetermined time interval to propel a predetermined metered quantity of molten adhesive from said metering chamber; and a float assembly operative in response to a predetermined molten adhesive level in said reservoir chamber to cause release of said clamp assemblies to permit downward movement of said adhesive cartridge onto said upper edges of said plurality of spaced plates for melting of a predetermined quantity of adhesive to maintain a predetermined quantity of molten adhesive in said reservoir chamber.

26. Adhesive dispensing apparatus comprising:

a hot melt adhesive gun comprising:

a housing having a hot melt chamber for containing a charge of molten hot melt adhesive, and an air chamber adapted to contain a supply of pressurized air;

a flexible diaphragm disposed within said gun housing between said hot melt chamber and said air chamber, said diaphragm isolating said hot melt chamber from said air chamber;

means for heating said hot melt chamber to a predetermined temperature to maintain said adhesive in a molten condition;

a nozzle in fluid communication with said hot melt chamber;

a normally closed needle valve within said nozzle;

trigger means operative upon manual actuation to open said needle valve to permit the flow of adhesive from said nozzle;

an inlet port mounted on the forward end of said hot melt chamber;

a passageway coupling said hot melt chamber with said inlet port and coupling said nozzle with said hot melt chamber;

a normally closed slide valve disposed in said inlet port and adapted to be opened by the application of pressure applied by hot melt adhesive from a bulk supply unit to permit passage of a quantity of melted adhesive through said passageway and into said hot melt chamber;

means for introducing a supply of pressurized air into said air chamber to cause said diaphragm to deform towards said nozzle to cause expulsion of melted adhesive from said hot melt chamber through said nozzle when said needle valve is in an opened position; and a bulk supply unit comprising:

a supply housing having a heated reservoir chamber for containing a predetermined quantity of molten hot melt adhesive;

a plurality of clamp assemblies disposed on said supply housing above said reservoir chamber and operative to retain an adhesive cartridge in a desired position and to selectively permit downward movement thereof into said reservoir chamber for melting selected portions thereof;

a plurality of spaced plates disposed within said reservoir chamber and extending upwardly to a height approximately equal to the maximum level of the supply of molten adhesive therein, said plates having upper edges against which a lower end of said adhesive cartridge is permitted to rest during melting thereof;

a metering chamber disposed below said reservoir chamber and having a first valve means selectively coupling said reservoir chamber to said metering chamber and a second valve means selectively coupling said metering chamber to a supply nozzle;

a piston associated with said metering chamber for drawing a predetermined quantity of molten adhesive into said metering chamber from said reservoir chamber through said first valve means and for propelling the metered quantity of molten adhesive from said metering chamber through said nozzle to said inlet port of said adhesive gun coupled to said supply nozzle;

pneumatic means for actuating said piston for a predetermined time interval to propel a predetermined metered quantity of molten adhesive from said metering chamber; and a float assembly operative in response to a predetermined molten adhesive level in said reservoir chamber to cause release of said clamp assemblies to permit downward movement of said adhesive cartridge onto said upper edge of said plurality of spaced plates for melting of a predetermined quantity of adhesive to maintain a predetermined quantity of molten adhesive in said reservoir chamber.

27. A hot melt adhesive supply system comprising:

a housing having a heated reservoir chamber for containing a predetermined quantity of molten hot melt adhesive;

a ramp for containing a plurality of solid hot melt adhesive slugs and having an upper end adapted to receive additional slugs and a lower end adjacent said reservoir chamber adapted to permit adhesive slugs to fall therefrom and into said reservoir chamber;

a pivotally mounted feed plate having a first upwardly extending lip disposed on a side thereof facing said upper end of said ramp and a second upwardly extending lip disposed on a side thereof facing said lower end of said ramp;

first pneumatic means for pivoting said feed plate in a first direction to lower said first lip below the level of said ramp to permit a slug to roll onto said feed plate, and for pivoting said feed plate in a second direction to lower said second lip below the level of said ramp to permit an adhesive slug on said feed plate to be dispensed therefrom toward said lower end of said ramp and into said reservoir chamber and to simultaneously raise said first lip above the level of said ramp to prevent others of said adhesive slugs from moving toward said lower end;

a metering chamber disposed below said reservoir chamber and including a first valve means selectively coupling said reservoir chamber to said metering chamber and a second valve means selectively coupling said metering chamber to a supply nozzle;

a piston slidably disposed in said metering chamber;

second pneumatic means adapted for actuating said piston for a predetermined time interval to draw a predetermined metered quantity of molten adhesive through said first valve means and into said metering chamber and to propel said metered quantity of molten adhesive from said metering chamber through said supply nozzle; and a float assembly operative in response to a predetermined molten adhesive level in said reservoir chamber to cause actuation of said first pneumatic means to cause said feed plate to dispense a predetermined number of adhesive slugs into said reservoir chamber to maintain a predetermined quantity of molten adhesive in said reservoir chamber.

28. The hot melt adhesive supply system of claim 27 wherein said supply nozzle is adapted for coupling to an inlet port of an adhesive gun and includes means to enable charging of said adhesive gun from said metering chamber only when said supply nozzle is coupled to said gun.

29. A hot melt adhesive supply system comprising:

a housing having a heated reservoir chamber for containing a predetermined quantity of molten hot melt adhesive;

means disposed on said housing in communication with said reservoir chamber and adapted to receive normally solid adhesive for melting thereof in said reservoir chamber;

a plurality of spaced plates disposed within said reservoir chamber and extending upwardly to a height approximately equal to the maximum level of the supply of molten adhesive therein;

a metering chamber disposed below said reservoir chamber and having a first valve means selectively coupling said reservoir chamber to said metering chamber and a second valve means selectively coupling said metering chamber to a supply nozzle;

a piston associated with said metering chamber for drawing a predetermined quantity of molten adhesive into said metering chamber from said reservoir chamber through said first valve means and for propelling the metered quantity of molten adhesive from said metering chamber through said second valve means and said supply nozzle to an adhesive gun coupled to said supply nozzle; and pneumatic means for actuating said piston for a predetermined time interval to propel a predetermined metered quantity of molten adhesive from said metering chamber and into said adhesive gun.

30. Adhesive dispensing apparatus comprising:

a hot melt adhesive supply system comprising:

a housing having a heated reservoir chamber for containing a predetermined quantity of molten hot melt adhesive;

means disposed on said housing in communication with said reservoir chamber and adapted to receive normally solid adhesive for melting thereof on said reservoir chamber;

a plurality of spaced plates disposed within said reservoir chamber and extending upwardly to a height approximately equal to the maximum level of the supply of molten adhesive therein;

a metering chamber disposed below said reservoir chamber and having a first valve means selectively coupling said reservoir chamber to said metering chamber and a second valve means selectively coupling said metering chamber to a supply nozzle;

a piston associated with said metering chamber for drawing a predetermined quantity of molten adhesive into said metering chamber from said reservoir chamber through said first valve means and for propelling the metered quantity of molten adhesive from said metering chamber through said second valve means and said supply nozzle to an adhesive gun coupled to said supply nozzle; and pneumatic means for actuating said piston for a predetermined time interval to propel a predetermined metered quantity of molten adhesive from said metering chamber and into said adhesive gun; and a hot melt adhesive gun comprising:

a gun housing having a hot melt chamber for containing a charge of molten hot melt adhesive, and an air chamber adapted to contain a supply of pressurized air;

a piston slidably disposed within said housing and providing a movable barrier between said hot melt chamber and said air chamber, said piston isolating said hot melt chamber from said air chamber;

means for heating said hot melt chamber to a predetermined temperature to maintain said adhesive in a molten condition;

a nozzle in fluid communication with said hot melt chamber;

a normally closed valve within said nozzle;

manually-operated trigger means adapted to open said nozzle valve to permit dispensing of molten adhesive through said nozzle;

an inlet port mounted on the forward end of said hot melt chamber;

a passageway coupling said hot melt chamber with said inlet port;

a normally closed valve disposed in said inlet port and adapted to be opened by the application of pressure applied by hot melt adhesive from said supply nozzle to permit passage of a metered quantity of melted adhesive through said passageway and into said hot melt chamber; and means adapted for supplying pressurized air to said air chamber to urge said piston towards said hot melt chamber to provide adhesive pressure in said hot melt chamber.

* * * * *

Disclaimer 4,199,082.—*Robert L. Ornsteen, Cape Neddick, Maine.* HOT MELT ADHESIVE GUN. Patent dated April 22, 1980. Disclaimer filed Jan. 9, 1981, by the assignee, *Ornsteen Chemicals, Inc.*

Hereby enters this disclaimer to claims 1, 3, 4, 5, 6, 7, 23 and 24 of said patent.

[*Official Gazette March 24, 1981.*]